US010358892B2

(12) United States Patent
Wakefield et al.

(10) Patent No.: US 10,358,892 B2
(45) Date of Patent: Jul. 23, 2019

(54) SLIDING SLEEVE VALVE WITH DEGRADABLE COMPONENT RESPONSIVE TO MATERIAL RELEASED WITH OPERATION OF THE SLIDING SLEEVE

(71) Applicant: Baker Hughes, a GE company, LLC, Houston, TX (US)

(72) Inventors: John K. Wakefield, Cypress, TX (US); Zachary S. Leonard, Magnolia, TX (US); Colin P. Andrew, Cypress, TX (US); Matthew Stone, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/658,560

(22) Filed: Jul. 25, 2017

(65) Prior Publication Data

US 2019/0032447 A1 Jan. 31, 2019

(51) Int. Cl.

| | |
|---|---|
| ***E21B 34/06*** | (2006.01) |
| ***E21B 43/26*** | (2006.01) |
| ***E21B 34/14*** | (2006.01) |
| *E21B 34/00* | (2006.01) |

(52) U.S. Cl.

CPC ..... *E21B 34/063* (2013.01); *E21B 34/14* (2013.01); *E21B 43/26* (2013.01); *E21B 2034/007* (2013.01)

(58) Field of Classification Search

CPC ..... E21B 34/063; E21B 34/14; E21B 43/26; E21B 2034/007

See application file for complete search history.

(56) References Cited

U.S. PATENT DOCUMENTS

| | | | | |
|---|---|---|---|---|
| 8,573,295 | B2 | 11/2013 | Johnson et al. | |
| 8,991,509 | B2 * | 3/2015 | Merron | E21B 43/26 166/386 |
| 9,033,055 | B2 * | 5/2015 | Mccoy | E21B 34/14 166/373 |
| 9,079,246 | B2 | 7/2015 | Xu et al. | |
| 9,765,595 | B2 * | 9/2017 | Themig | E21B 43/14 |
| 9,920,601 | B2 * | 3/2018 | Carrejo | E21B 43/12 |
| 10,036,229 | B2 * | 7/2018 | Bacsik | E21B 34/063 |
| 2013/0146302 | A1 | 6/2013 | Gaudette et al. | |
| 2014/0027127 | A1 * | 1/2014 | Frazier | E21B 33/00 166/376 |

(Continued)

*Primary Examiner* — Matthew R Buck

*Assistant Examiner* — Aaron L Lembo

(74) *Attorney, Agent, or Firm* — Shawn Hunter

(57) ABSTRACT

Salt or acid solution is stored inside a frac sleeve instead of being pumped from a surface location. A mechanically-actuated valve releases the stored salt or acid solution into the borehole to electrochemically degrade the frac ball and allow it to pass through the seat. The stored fluid can be immediately released upon mechanical actuation or released after a specified delay using an integrated timer. In multiple sleeve applications a first ball shifts a first sleeve to open treatment ports and a second ball shifts a second sleeve to close the treatment port and open screened production ports while releasing the stored material either between the seated objects or above one of the seated objects to initiate the disintegration that will allow objects on both seats to disintegrate and pass through.

28 Claims, 5 Drawing Sheets

(56) References Cited

U.S. PATENT DOCUMENTS

| | | | | |
|---|---|---|---|---|
| 2014/0246209 | A1* | 9/2014 | Themig | E21B 43/14 166/374 |
| 2017/0067314 | A1* | 3/2017 | Flores Perez | E21B 34/10 |
| 2017/0342806 | A1* | 11/2017 | Themig | E21B 43/14 |
| 2018/0128082 | A1* | 5/2018 | Hollan | E21B 34/14 |
| 2018/0238133 | A1* | 8/2018 | Fripp | E21B 34/10 |

* cited by examiner

SLIDING SLEEVE VALVE WITH DEGRADABLE COMPONENT RESPONSIVE TO MATERIAL RELEASED WITH OPERATION OF THE SLIDING SLEEVE

FIELD OF THE INVENTION

The field of the invention is sliding sleeves shifted with a landed object on a seat and more particularly where the material that initiates degradation or disintegration of the object or seat is released directly or indirectly with sleeve movement.

BACKGROUND OF THE INVENTION

Traditionally, salt or acid solutions are pumped downhole to electrochemically degrade material in the frac ball (i.e., IN-Tallic®) to shrink the ball and pass it through the ball seat. However, this method is relatively slow and is not always possible due to adverse downhole conditions such as packing off of proppant above the seat.

IN-Tallic® is an electrochemically degradable material commonly used in frac balls and ball seats. When an electrolyte such as KC1 is pumped downhole, a galvanic corrosion reaction is initiated that degrades the frac ball or ball seat, eventually allowing the ball to be cleared from the seat. However, adverse downhole conditions can sometimes make it impossible to pump a salt or acid solution downhole to reach the degradable material. For example, proppant can build up above the ball seat, preventing the solution from reaching the frac ball. Additionally, depending on formation properties, operators may not want to add a large amount of salt or acid to the frac fluid. A high concentration of salt or acid solution (i.e., 10% KC1) is required at surface to achieve an adequate concentration (i.e., 2% KC1) at the frac sleeve, which may be 8,000 meters downhole in an offshore well.

The production ports of the upper sleeve of multi-sleeve tools have inserts filled with beads to provide screening of the production fluid. These inserts are known as bead-pack screens or bead screens. Such tools have several rows of production ports, each with several bead screens arranged along the circumference. In these tools a first sleeve is shifted to open treatment ports and then a second sleeve is shifted to open the screened production ports while closing the treatment ports.

In one aspect, the present invention presents a mechanically-actuated valve that allows the storage and release of fluid from a chamber inside a frac sleeve to degrade the frac ball or ball seat, allowing the ball to pass through the seat. The salt or acid solution is contained in a chamber inside the frac sleeve to ensure the solution will reach the degradable material. Pressuring up behind a seated ball causes the sleeve to shift and open a valve which releases the solution from an inner chamber into the fluid surrounding the frac ball. After the mechanical actuation of the valve, the released solution will initiate a galvanic corrosion reaction in the frac ball to degrade it and pass it through the seat.

A frac sleeve can be built with an inner chamber that is filled with a high-concentration salt or acid solution selected to electrochemically degrade the frac ball or seat. The chamber has a valve that is normally closed, containing the fluid inside the sleeve until activation. Once the ball is seated and pressure is built up, an inner sleeve is shifted. The shifting of the sleeve can either instantly open the valve to the inner chamber or initiate a timer to open the valve after a set time. Once the valve is opened, the salt or acid solution is released from the chamber into borehole, where it surrounds the frac ball and seat and begins the electrochemical degradation of the material. After enough material has been removed from the outside of the ball or inner wall of the seat, the ball will pass through the seat and subsequent operations such as production can be carried out.

The invention ensures the frac ball/seat will degrade even with adverse downhole conditions such as packing off of proppant above the seat; faster degradation of frac ball; elimination of delay from pumping down the salt or acid solution and/or reduced volume of salt or acid solution needed to degrade a ball. Placement in the sleeve reduces loss of concentration from pumping down fluid. Applications in a variety of tools that use degradable materials is envisioned.

Relevant art includes U.S. Pat. No. 8,573,295; 9,079,246 and US 20130146302.

SUMMARY OF THE INVENTION

Salt or acid solution is stored inside a frac sleeve instead of being pumped from a surface location. A mechanically-actuated valve releases the stored salt or acid solution into the borehole to electrochemically degrade the frac ball and allow it to pass through the seat. The stored fluid can be immediately released upon mechanical actuation or released after a specified delay using an integrated timer. In multiple sleeve applications a first ball shifts a first sleeve to open treatment ports and a second ball shifts a second sleeve to close the treatment port and open screened production ports while releasing the stored material either between the seated objects or above one of the seated objects to initiate the disintegration that will allow objects on both seats to disintegrate and pass through.

DETAILED DESCRIPTION OF THE PREFERRED EMBODIMENT

Figure 1:
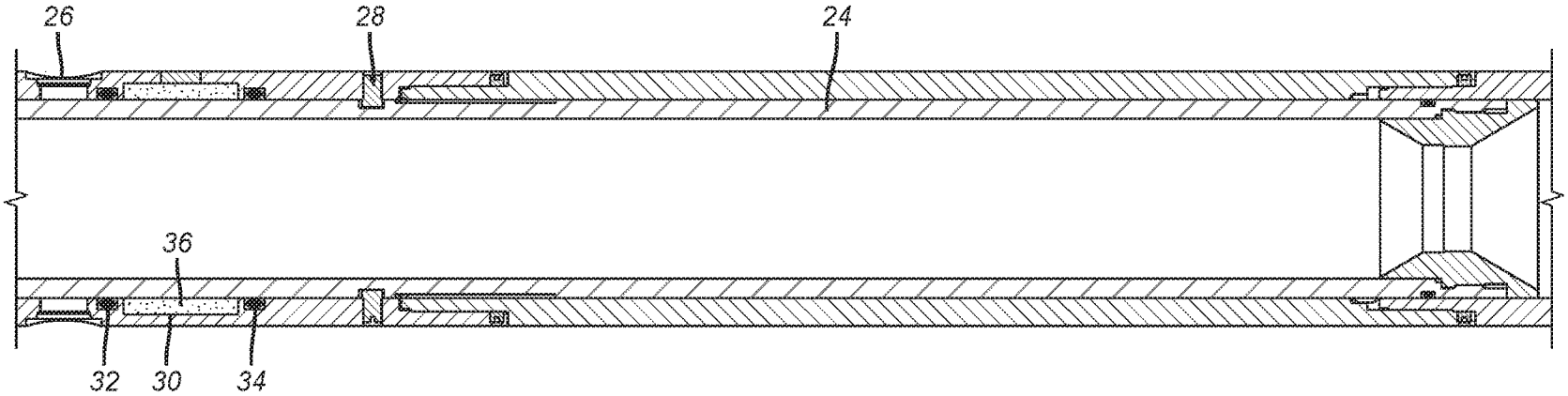
FIG. 1 is a run in section view of a sliding sleeve valve with an associated sealed chamber for a material that will cause disintegration when released.
Figure 2:
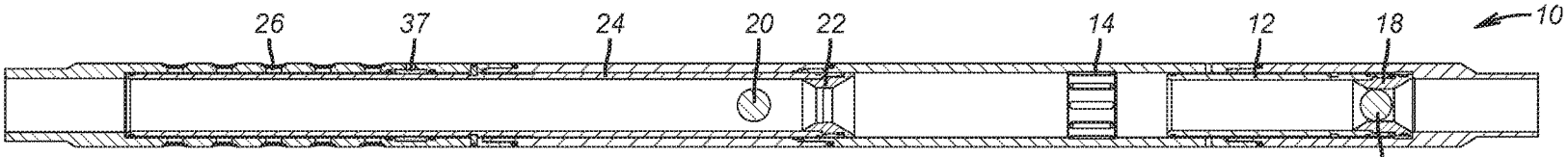
FIG. 2 is the view of FIG. 1 with the treatment ports open and a second ball on the way to a second sleeve.

Referring to FIG. 2 a ported sleeve assembly 10 being one of many that are used in a treatment and which are axially spaced to treat isolated portions of an interval using annulus packers (not shown) is illustrated. It has a lower sleeve 12 that initially closes treatment ports 14 until an object such as a ball 16 is landed on seat 18 and pressure is applied to move sleeve 12 into the FIG. 2 position. After the treatment is completed another object such as ball 20 is delivered to seat 22 such that pressure applied on seated ball 20 shifts the upper sleeve 24 to open screened production ports 26. Referring to FIG. 1, sleeve 24 is initially pinned with shear pin or pins 28 which break when sleeve 24 is moved with pressure on ball 20 when seated on seat 22. Annular chamber 30 is formed between seals 32 and 34 sealing against sleeve 24 until sleeve 24 is shifted with pressure to move past at least seal 32 to allow the material or disintegrating agent 36 that will initiate disintegration of balls 16 and 20 to be released.

Figure 3:
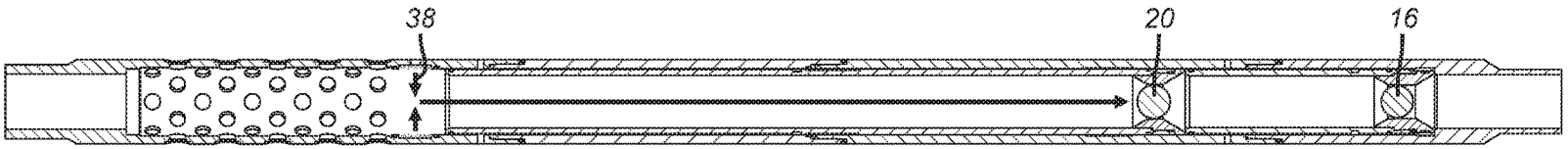
FIG. 3 is the view of FIG. 2 shows an upper sleeve shifted with the second ball to release the material that causes disintegration and to open the production ports.
Figure 4:
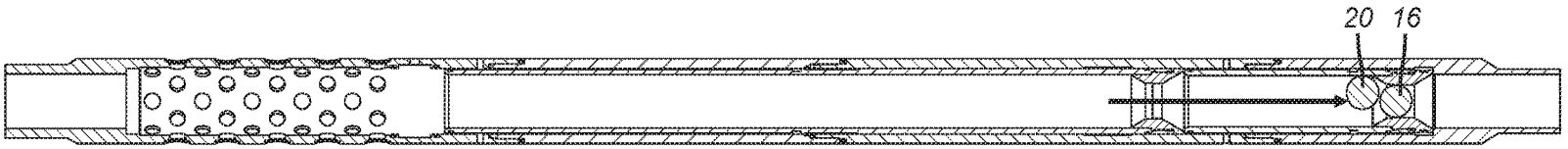
FIG. 4 is the view of FIG. 3 with the upper ball disintegrated and moved past its seat.
Figure 5:
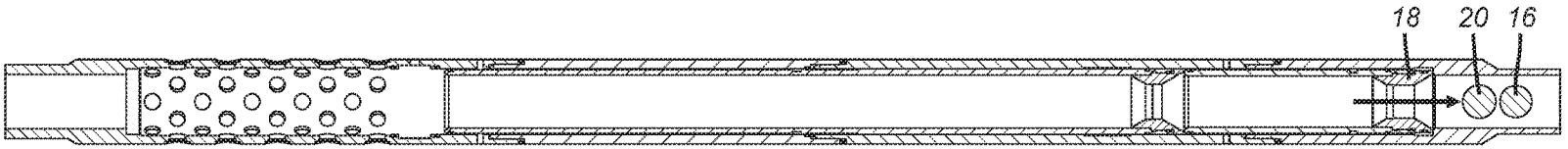
FIG. 5 is the view of FIG. 4 with both balls disintegrated and moved through both seats.

Arrows 38 in FIG. 3 show the material 37 escaping and traveling toward balls 16 and 20. FIG. 4 shows sufficient disintegration of ball 20 to allow it to pass seat 22 and land on ball 16. FIG. 5 shows sufficient disintegration of ball 16 to allow balls 16 and 20 to pass seat 18. The same thing happens at other assemblies 10 located at other isolated intervals in the borehole as part of the treatment followed by production from the various intervals. Preferably, the intervals are treated and production ports opened in a bottom up direction. While just the balls or objects such as 16 and 20 can be disintegrated and production occur with seats 18 and 22 intact, the material for the seats 18 and 22 can also disintegrate.

Figure 6:
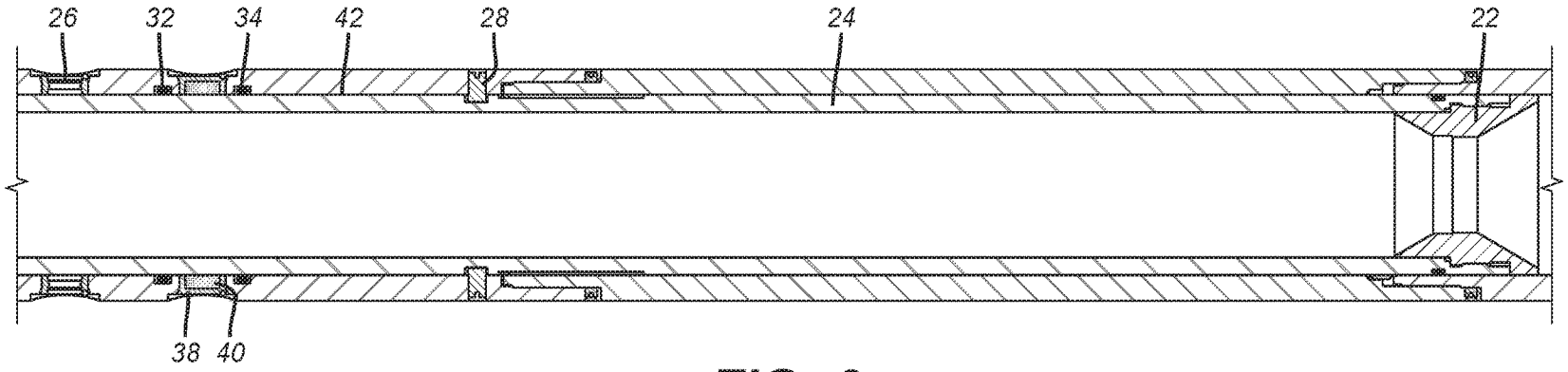
FIG. 6 is a detailed view of an upper sleeve showing the material that causes disintegration in some of the production ports in a run in position.
Figure 7:
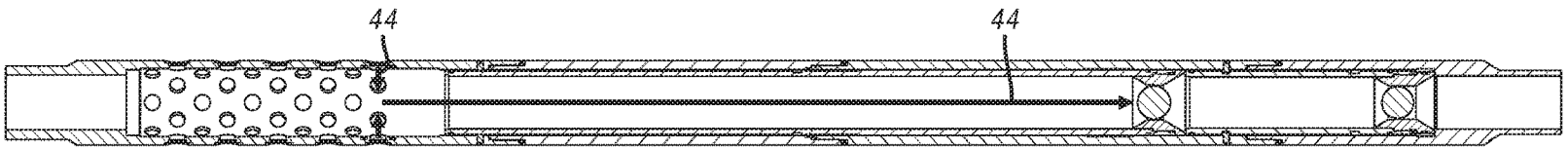
FIG. 7 is the view of FIG. 6 with the upper sleeve shifted exposing the production ports and the storage location for the material that causes disintegration of the balls or/and seats.

FIG. 6 shows a three sided cap 38 that holds a solid form of a material or agent that will initiate disintegration of the objects such as for example land on seat 22. The cap 38 has an open face against outer surface 42 of upper sleeve 24 such that in the FIG. 6 position the material or disintegrating agent 40 that is preferably in solid form in this embodiment can be held between seals 32 and 34 until shifting of sleeve 24 exposes the material 40 to tubing fluid and the material or agent is put into solution and travels to seats 22 and then 18 to initiate disintegration of at least balls 16 and 20 as previously described. Arrows 44 in FIG. 7 schematically illustrate this effect. The material 40 can travel due to gravity in a vertical well or/and due to a higher specific gravity than the well fluids to reach the seats 18 and 22.

Some of the bead screen inserts in production ports 26 in FIG. 6 could be replaced with a plug with the same housing dimensions but without the beads. This plug would be filled with acid and will be sealed to prevent the acid from leaking to the annulus outside the tool. The metal plug could have a pocket molded with an acid such as polylactic acid (PLA) or polyglycolic acid (PGA). Before the sleeve 24 is shifted, the acid 40 is sealed in the plugs. After the sleeve 24 is shifted, the acid dissolves into the borehole fluid and can be weighted so that is will sink downwards to the ball seats 22 and 18.

FIG. 6 shows a possible embodiment of an acid-filled plug in a tool. The left row of production ports have standard bead screen inserts while the right row of ports has acid-filled plugs. The plugs have a metal housing that is threaded into the sleeve from the OD like standard bead screens, but have a metal cap to seal the acid 40 in the plug. O-rings 32 and 34 are placed on the uphole and downhole end of the row of ports to prevent fluid from reaching the acid 40 in the plugs.

Figure 8:
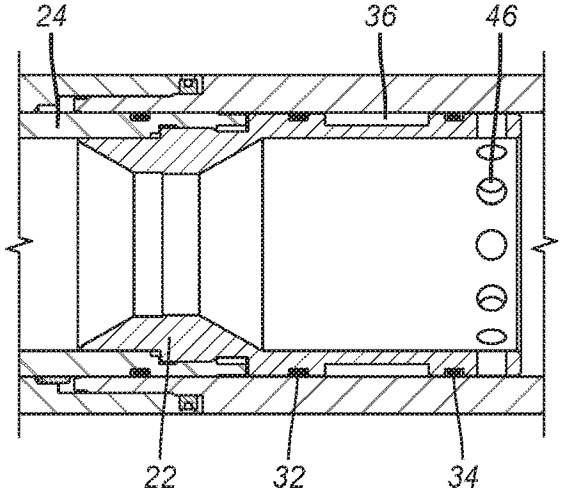
FIG. 8 is the view of FIG. 7 showing a detail of an annular chamber holding the material that causes disintegration attached to the lower end of the upper sleeve.
Figure 9:
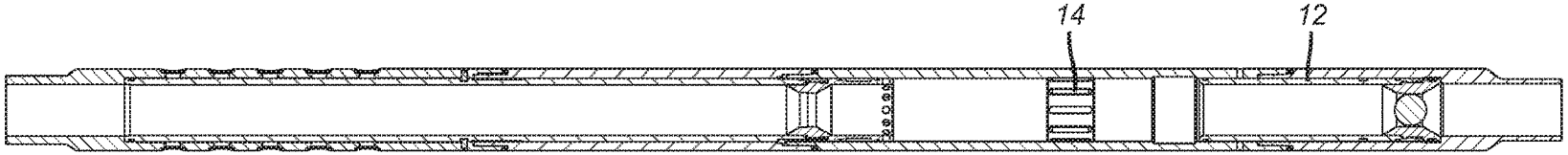
FIG. 9 is a view of the lower sleeve shifted to open the treatment ports.
Figure 10:
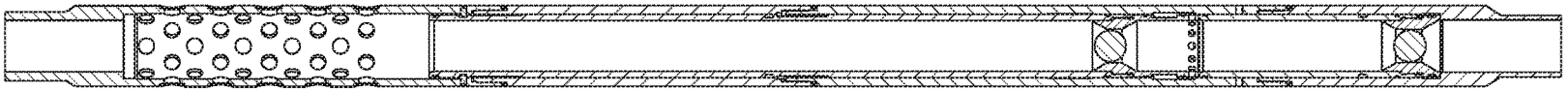
FIG. 10 is the view of FIG. 9 with the upper sleeve shifted to close the treatment ports, open the production ports and release the material that initiates disintegration between the seated balls.
Figure 11:
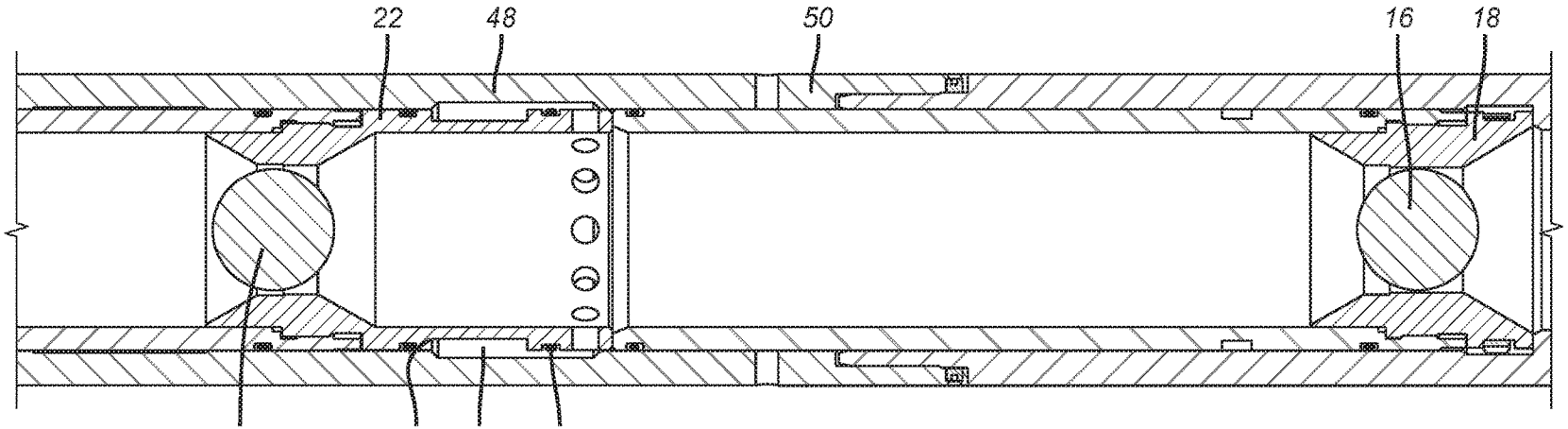
FIG. 11 is a detailed view of FIG. 10 showing the manner in which the material escapes by bypassing one of the annular chamber seals.

FIG. 8 integrates into seat 22 an annular chamber 36 for the material that initiates disintegration using seals 32 and 34 as previously described. An array of ports 46 is disposed on an opposite side of annular chamber 36 from seal 34. As ball seat 22 shifts from pressure on ball 20 on seat 22 as shown in FIGS. 10 and 11, seal 34 enters a groove 48 in housing 50 allowing material to bypass seal 34 and enter between seated balls 20 and 16. The disintegration of both balls can begin. It should be noted that the volume of chamber 36 can be decreased as seal 34 enters groove 48 by configuring the location of radial surface 52 to decrease the volume of chamber 36 to push out the material that is stored therein. The fluid can be forcibly displaced from chamber 36 by lifting ball 20 off of seat 22. FIG. 9 shows the opening of the treatment ports 14 with the initial movement of lower sleeve 12 as previously discussed.

The size of the chamber 36 can be designed to create a desired acid concentration in the fluid volume between the ball seats 18 and 22. For example, if the seats are 18" apart on a tool with 3.7" ID, a 2" long chamber filled with near-100% concentration acid would produce a solution concentration of about 3%, which should be adequate for dissolution of IN-Tallic® material. The spacing of the seats, size of the acid chamber, and type of acid can be optimized to increase acid concentration of the solution and the corrosion rate of the degradable material.

In FIGS. 1-5 the assumption is that the frac sleeve will be roughly oriented vertically, as is commonly the case in offshore wells, so that gravity will carry the salt or acid solution downhole to both the ball seats. However, the location and number of the chambers can be customized to fit the well orientation. For example, a second chamber and valve could be added between the ball seats as in FIG. 11 to release salt or acid solution between the ball seats.

Another alternative is to use the shifting of the sleeve 24 to initiate a timer for a delayed release of the salt or acid solution. The addition of a timer could potentially enable application in a traditional frac sleeve with a single port and ball seat. Shifting the sleeve would allow normal hydraulic fracturing through the port. After the specified time (after fracturing is completed), the valve releases the solution and initiates the galvanic corrosion reaction on the frac ball. This allows the ball and seat to seal off the stage from lower stages until fracturing is complete to avoid re-fracking lower stages in the string.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers, etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A borehole assembly, comprising:

at least one housing having a passage therethrough, each housing further comprising at least one wall port selectively opened with movement of at least one sliding sleeve within the passage, the housing radially surrounding the passage and at least one sliding sleeve, wherein movement of said sliding sleeve selectively, immediately or with a time delay, releases an agent which is stored between said housing and said at least one sliding sleeve, the agent being stored within a chamber that is seated off from the passage and on axial sides, movement of the at least one sliding sleeve undermining at least one seal for the chamber where said agent is stored;

wherein said agent causes disintegration of an actuation component for said sliding sleeve which opens said passage.

2. The assembly of claim 1, wherein:

said time delay comprises a timer started with said movement of said at least one sleeve to operate a valve to release said agent into said passage.

3. The assembly of claim 1, wherein:

said at least one seal is undermined by movement of said chamber to be in alignment with a recess in said housing.

4. The assembly of claim 1, wherein:

said at least one sleeve comprises a lower and upper sleeves, wherein movement of said lower sleeve opens at least one treatment port and movement of said upper sleeve closes said at least one treatment port and opens at least one production port and releases agent from said housing into said passage.

5. The assembly of claim 4, wherein:

said agent is stored in a chamber adjacent said at least one production port in solid or liquid form and movement of said upper sleeve allows said agent to leave said chamber and enter said passage.

6. The assembly of claim 4, wherein:

said lower sleeve comprises a lower seat and said upper sleeve comprises an upper seat;

said lower seat accepting a lower object thereon to close said passage for movement of said lower sleeve with pressure applied to said lower object.

7. The assembly of claim 6, wherein:

said chamber is defined between said upper seat and said housing;

said chamber moves in tandem with said upper sleeve to position said chamber adjacent a housing recess thereby undermining at least one seal for said chamber to allow said agent to enter said passage between said seats.

8. The assembly of claim 7, wherein:

said agent in said passage disintegrates said objects to reopen said passage.

9. The assembly of claim 7, wherein:

said undermining said at least one seal creates a path from said chamber to a plurality of circumferentially spaced openings in said upper seat for communication with said passage.

10. The assembly of claim 7, wherein:

said undermining of said at least one seal reduces a volume of said chamber to push said agent into said passage.

11. The assembly of claim 8, wherein:

said objects pass through said lower seat after disintegrating.

12. The assembly of claim 6, wherein:

said agent disintegrates said upper and lower seats.

13. The assembly of claim 5, wherein:

said lower sleeve comprises a lower seat and said upper sleeve comprises an upper seat;

said lower seat accepting a lower object thereon to close said passage for movement of said lower sleeve with pressure applied to said lower object;

said upper seat accepting an upper object to close said passage for movement of said upper sleeve with pressure applied to said upper object;

said chamber is defined between said upper sleeve and said housing;

said agent is released from said chamber when movement of said upper sleeve exposes said at least one production port and at least one seal for said chamber.

14. The assembly of claim 13, wherein:

said agent in said passage disintegrates said objects to reopen said passage.

15. The assembly of claim 14, wherein:

said objects pass through said lower seat after disintegrating.

16. The assembly of claim 14, wherein:

said agent disintegrates said upper and lower seats.

17. A borehole treatment method, comprising:

pumping treatment fluid through at least one wall port in at least one housing having a passage therethrough, said at least one wall port selectively opened with movement of at least one sliding sleeve within the passage, the housing radially surrounding the passage and at least one sliding sleeve;

releasing an agent which is sealed from the passage within a chamber between the housing and sleeve and on axial sides of the chamber by moving said at least one sliding sleeve;

disintegrating, at least in part, at least one actuator for said at least one sleeve with said agent.

18. The method of claim 17, comprising:

triggering a timer to open a valve to release said agent from said housing with said movement of said at least one sliding sleeve.

19. The method of claim 17, comprising:

undermining at least one seal for said chamber with movement of said at least one sliding sleeve.

20. The method of claim 19, comprising:

moving said chamber with said at least one sliding sleeve into alignment with a recess in said housing for said undermining of said at least one seal.

21. The method of claim 20, comprising:

reducing a volume of said chamber when undermining said at least one seal to push said agent from said chamber.

22. The method of claim 17, comprising:

providing as said at least one sleeve a lower an upper sleeves;

moving said lower sleeve to open at least one treatment port of said at least one port;

moving said upper sleeve to open at least one treatment port and to open at least one production port of said at least one port, said movement of said upper sleeve releases said agent from said chamber into a passage in said at least one housing.

23. The method of claim 22, comprising:

storing said agent in a chamber adjacent said at least one production port in solid or liquid form;

allowing said agent to leave said chamber and enter said passage with movement of said upper sleeve that uncovers said at least one production port.

24. The method of claim 22, comprising:

providing a lower seat in said lower sleeve;

providing an upper seat in said upper sleeve;

landing a lower object in said lower seat to close said passage for movement of said lower sleeve with pressure applied to said lower object;

landing an upper object on said upper seat to close said passage for movement of said upper sleeve with pressure applied to said upper object;

storing said agent in a chamber between or uphole of said seats.

25. The method of claim 24, comprising:

locating said chamber between said upper seat and said housing;

moving said chamber in tandem with said upper sleeve to position said chamber adjacent a housing recess thereby undermining at least one seal for said chamber to allow said agent to enter said passage between said seats.

26. The method of claim 24, comprising:

disintegrating said objects with said agent to allow said objects to pass through said lower seat.

27. The method of claim 26, comprising:

disintegrating said seats with said agent.

28. The method of claim 17, comprising:

performing a fracturing as said treatment.

* * * * *